US007555914B1

(12) United States Patent
Davis

(10) Patent No.: US 7,555,914 B1
(45) Date of Patent: Jul. 7, 2009

(54) SELF-CLEANING AIR CONDITIONER SYSTEM

(76) Inventor: Il Yoo Davis, 7945 Audubon Ave., A-6, Akexandria, VA (US) 22306

( * ) Notice: Subject to any disclaimer, the term of this patent is extended or adjusted under 35 U.S.C. 154(b) by 646 days.

(21) Appl. No.: 11/181,941

(22) Filed: Jul. 15, 2005

(51) Int. Cl.
*F25D 21/00* (2006.01)

(52) U.S. Cl. ..... 62/272

(58) Field of Classification Search ..... 62/272, 62/291, 354
See application file for complete search history.

(56) References Cited

U.S. PATENT DOCUMENTS 5,094,089 A * 3/1992 Lail ..... 62/429

* cited by examiner

*Primary Examiner*—Melvin Jones

(57) ABSTRACT

An air conditioning system. The system may include one or more of fan covers, each having a customized filter placed directly on an open sidewall, a main drain pan with air pockets that act as insulation, an auxiliary drain pan that can be reduced in shape for receiving runoff from the main drain pan, and a self-cleaning mechanism for cleaning the main filter of an air conditioning unit.

5 Claims, 3 Drawing Sheets

FIG. 6
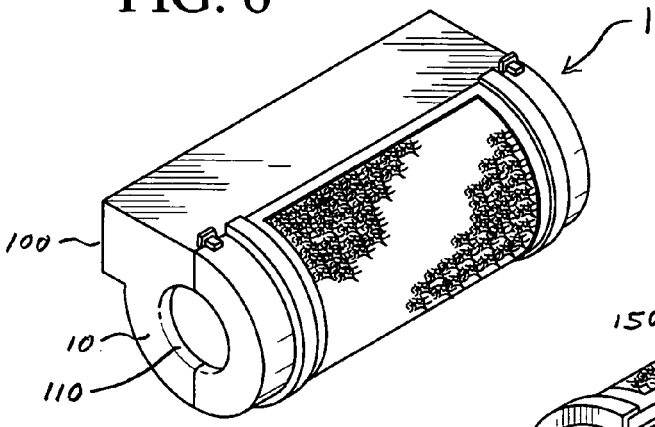
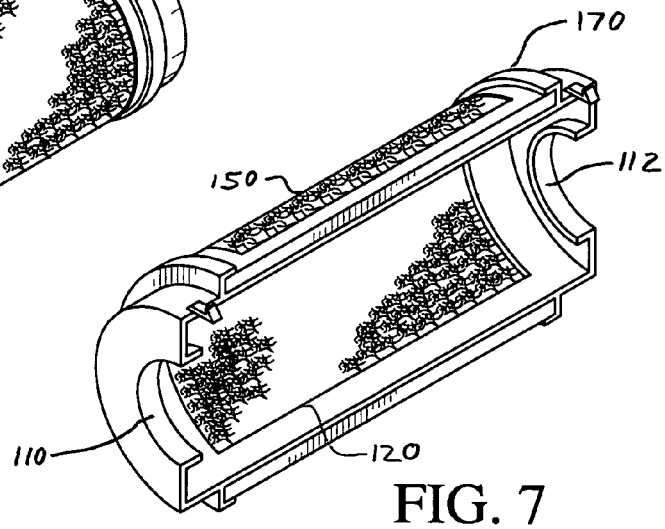
FIG. 7
FIG. 8
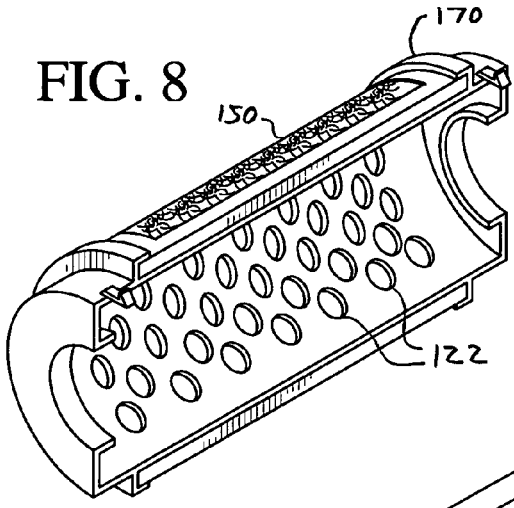
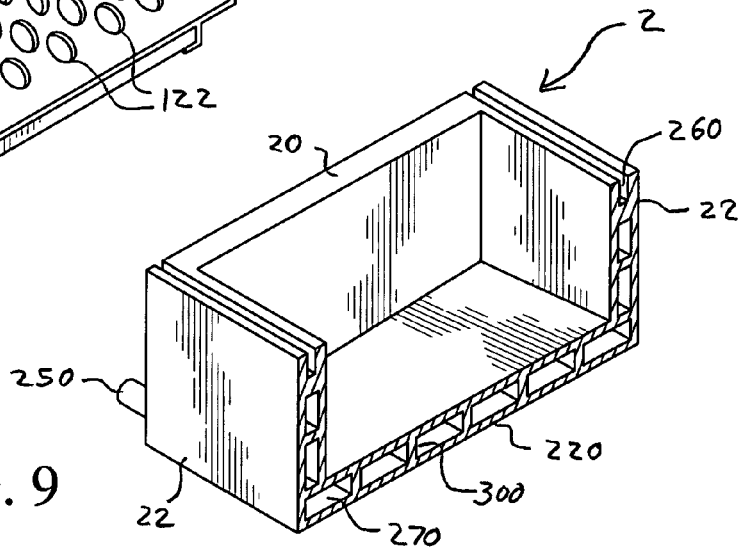
FIG. 9

SELF-CLEANING AIR CONDITIONER SYSTEM

BACKGROUND OF THE INVENTION

1. Field of the Invention

The present invention relates to a self-cleaning air conditioner system, more particularly to an automated filter cleaner that removes accumulated debris on the main filter of an air conditioner. The system further relates to a removable filter positioned on the blower of the air conditioner to further purify the circulated air, an insulated main drain pan with air cavities, and an auxiliary drain pan that can be reduced in size to avoid obstructions during installation.

2. Description of the Related Art

The main air conditioning filters of the known art are generally intended to be disposable once it has accumulated sufficient debris thereon. The amount of debris that accumulates on such filters can not be determined except by visual inspection or a sensor in the air conditioner that determines reduced air-flow. Consequently, the filters are generally disposed of periodically without regard to the accumulation of debris on the filter. Such periodic replacement of filters is labor intensive and may not be convenient to perform such tasks if the air conditioner is not easily accessible. Further, the main drain pans of the prior art are heavily insulated with insulation foam to prevent moisture buildup on the outer walls thereof when cold water is dropped from the heat exchange unit onto the main drains. The process of placing such insulation is very labor-intensive, thus adding to the cost of the units. In addition, the blowers for an air conditioning unit generally do not include filters placed thereon for removal of dirt from the circulated air. Additionally, auxiliary drain pans of the prior art that receive liquid flowing out of the main drain pans are generally uniform in size and can not be easily modified in size to correctly fit in narrow spaces during installation.

SUMMARY OF THE INVENTION

Accordingly, it is an object of the present invention to provide an automated filter cleaner which minimizes the problems of the prior art.

Another object of the invention is to provide a main drain pan having air pockets that act as insulation.

Yet another object of the invention is to provide a removable filter directly positioned on the main blower of an air conditioning unit to further filter the circulated air.

A further object of the invention is to provide an auxiliary drain that can easily be reconfigured in size so that it can be positioned to avoid obstructions during installation.

Other objects and further scope of applicability of the present invention will become apparent from the detailed description given hereafter. If should be understood that the detailed description and specific examples, while indicating preferred embodiments of the invention, are given by way of illustration only, since various changes and modifications within the spirit and scope of the invention will become apparent to those skilled in the art form this detailed description.

BRIEF DESCRIPTION OF THE DRAWINGS

The present invention will become more fully understood from the detailed description given below and the accompanying drawings are given by way of illustration only and thus are not limitative of the present invention, and wherein:

FIG. 6 is a perspective view of one embodiment of a main blower unit of the air conditioning unit of the present invention.

FIG. 7 is a perspective view of a portion of the main blower unit of FIG. 6.

FIG. 8 is a perspective view of a portion of the main blower unit of an alternative embodiment of a main blower unit.

FIG. 9 is a perspective, partially cutaway view of the main drain pan of the air conditioning unit of the present invention.

DETAILED DESCRIPTION OF THE PREFERRED EMBODIMENTS

For the purposes of illustrating the preferred embodiments of present invention, the drawings will be described in greater detail.

Figure 1:
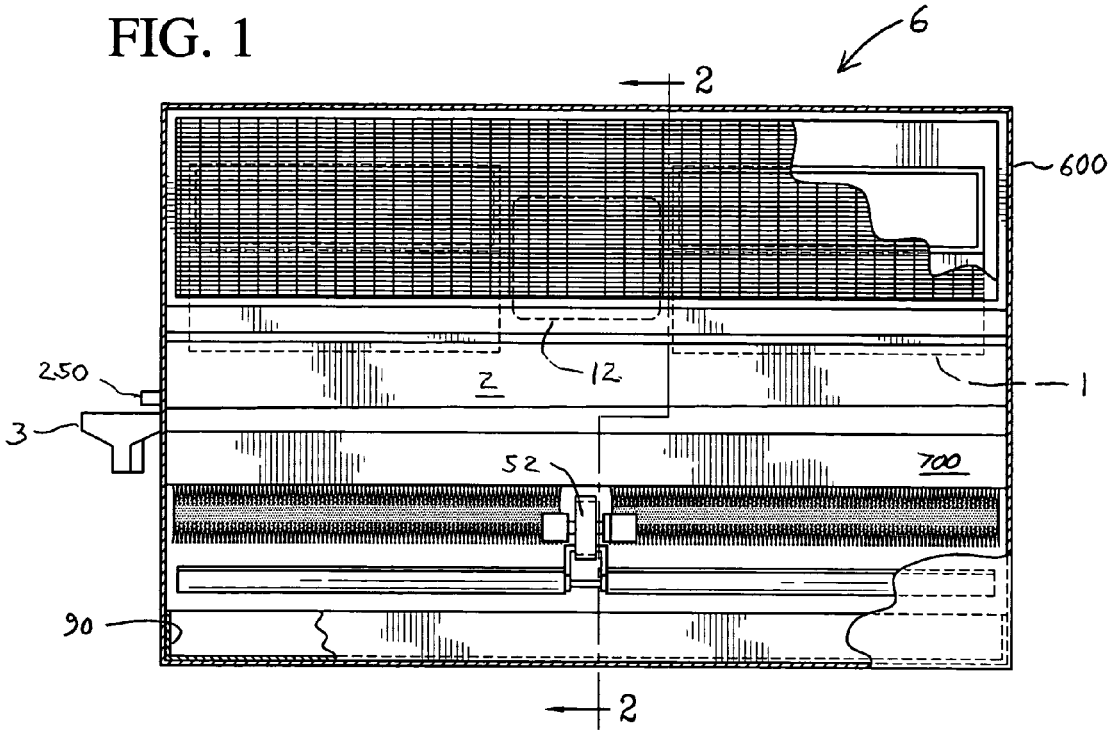
FIG. 1 is a front cutaway view of the air conditioning unit of the present invention.
Figure 2:
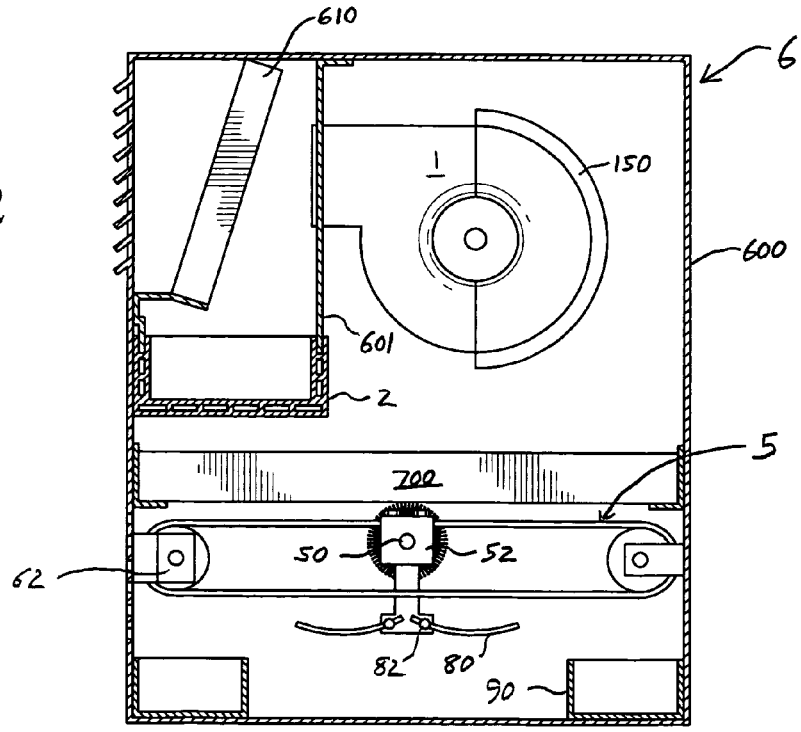
FIG. 2 is a side cutaway view of the air conditioning unit of the present invention along line 2-2 of FIG. 1.

FIGS. 1 and 2 briefly illustrate the overall invention. The air conditioning unit 6 includes a main housing 600 to which is secured fan covers 1 housing fans (not shown) powered by motor 12. A main drain pan 2 receives water droplets from the heat exchange unit 610 and water is drained out through the drain 250. An auxiliary drain pan 3 receives the water from the drain 250 and directs water through one of its drains 32. A main air filter 700 is positioned below the fan cover 1. A filter cleaning mechanism having a drive mechanism 5 cleans accumulated dirt or debris on the main filter 700 and drops the dirt between pans 80 into a receiver 90. The fan cover 1 includes an additional air filter 150.

FIGS. 6-8 illustrate embodiments of a main blower unit. FIGS. 7 and 8 illustrate half portions embodiments of the fan cover 1. The main blower includes a fan cover 1 for the air conditioning unit 6. The fan cover 1 includes a housing 10 having an air outlet 100, a pair of primary air inlets 110, 112 and a secondary air inlet 120. The primary air inlets 110, 112 are spaced apart, and the secondary air inlet 120 or 122 is positioned between the primary inlets. The fan cover is configured to receive a fan unit (not shown) inside the housing 10 such that air from the primary air inlet 110 and secondary air inlets 120 or 122 is drawn into the housing 10 and out of the air outlet 100 when the fan unit is activated. An air filter 150 is detachably attached on the housing 10 to cover the secondary air inlet 120 or 122. The function of the air filter 150 is to further purify the air that initially passes through the main air filter 700 of the air conditioner unit. The air filter 150 of the fan cover 1 may have embedded chemicals, sometimes referred to as function materials, that will destroy microbes including bacteria and viruses to further cleanse the air.

As illustrated in FIG. 8, the secondary air inlet 122 can be a multiplicity of relatively small cutouts instead of the embodiment of FIG. 7 which has a large single secondary air inlet 120. The embodiment of FIG. 8 may result in a more rigid overall fan cover structure.

As shown more clearly in FIGS. 7 and 8, the fan cover 1 includes an attachment device 170 configured to house the air filter 150. The attachment device 170 may be a pair of spaced apart sleeves with bent portions directed to one another that can receive and secure in place the air filter 150.

FIGS. 1, 2 and 9 more clearly illustrate the main drain pan 2. As shown in FIG. 9, the main drain pan 2 includes an inner pan 200 having a bottom wall and four sidewalls, and an outer pan 220 having a bottom wall and four sidewalls. Respective ones of the bottom walls and at least two opposing sidewalls of the inner and outer pans are spaced apart to form one or more air gaps 270 therebetween. The air gaps 270 act as insulation, thus avoiding the time-consuming process of manually attaching insulation material on the outer walls of a conventional drain pan. The main drain pan 2 of the present invention can be easily formed, i.e. via plastic injection molding, thus minimizing production costs. A main drain 250 extends from the inner pan 200 to the outer pan 220. The sidewalls of the inner and outer pans 200, 220 form pairs of opposing insulated sidewalls 22 and non-insulated sidewalls 20. The bottom wall of the inner pan 200 is configured so that liquid accumulated thereon is directed to the main drain 250 along the length of the spaced apart sidewalls of the inner and outer pans 200, 220, in other words, the bottom wall of the inner pan 200 can be inclined towards the main drain 250 such that the sidewalls 20 of the main drain pan 2 that connect the insulated sidewalls 22 need not be insulated because liquid is directed towards the drain 250 and thus cold liquid will not accumulate on either of the non-insulated sidewalls 20. Obviously it may be prudent to insulate all of the walls of the main drain pan with air pockets. Upon installation, the drain pan 2 should be tilted from the horizontal so that accumulated water is directed to the main drain 250.

As illustrated in FIG. 9, the air gaps 270 are formed by the presence of a multiplicity of ribs 300 that connect the inner and outer pans 200, 220. Such ribbed structure will improve the structural integrity of the main drain pan 2. Further indents 260 are formed between the outer edges of the spaced apart sidewalls of the inner and outer pans 200, 300, and the indents 260 are configured to secure the drain pan 2 to an air conditioning unit 6 by receiving matching or locking elements 601 connected to the housing 600 of the air conditioning unit 6, as illustrated in FIGS. 2 and 9, which will further prevent the tendency of the drain pan 2 from warping in shape after prolonged usage.

Figure 5:
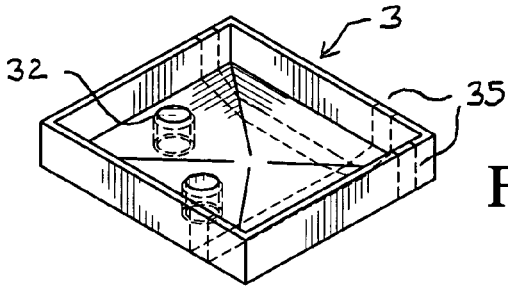
FIG. 5 is perspective view of the auxiliary drain pan of the air conditioning unit of the present invention.

FIGS. 1 and 5 illustrate the auxiliary drain pan 3. The auxiliary drain pan 3 receives liquid released through the drain 250 of the main drain pan 2, as shown in FIG. 1. With reference to FIG. 5, the auxiliary drain pan 3 includes a pair of drains 32 that are spaced apart at approximately at a right angle from the center of the auxiliary drain pan 3, unlike conventional auxiliary drain pans which have a single drain at the center thereof. The auxiliary drain pan 3 is of a substantially rectangular shape configured to receive liquid from a drain 250 of a main drain pan 2. The auxiliary drain pan 3 includes a pair of blocked auxiliary drains 32 that can be punched out and breaklines 35 along which the auxiliary drain pan 3 can be cut. The auxiliary drain pan 3 may have to be cut as stated above in order to avoid obstructions such as coolant lines and drain lines during installation. By being able to a remove section on one of at least two connecting sides of the auxiliary drain pan 3, the auxiliary drain pan 3 can be more easily installed in limited spaces. To facilitate the reconfiguration of the auxiliary drain pan 3, a breakline 35 of the auxiliary drain pan 3 is cut to remove a sidewall, and a sidewall attachment (not shown) must be attached, preferably by adhesive, to the open sidewall of the auxiliary drain pan 3 to prevent water from leaking out thereform, and one of the blocked auxiliary drains 32 must be unblocked, preferably by punching out to let the liquid escape therethrough. It is preferable to unplug the blocked drain 32 opposite the break line 35 that is cut so that the now opened drain is relatively centered in the reconfigured auxiliary drain pan 3.

Figure 3:
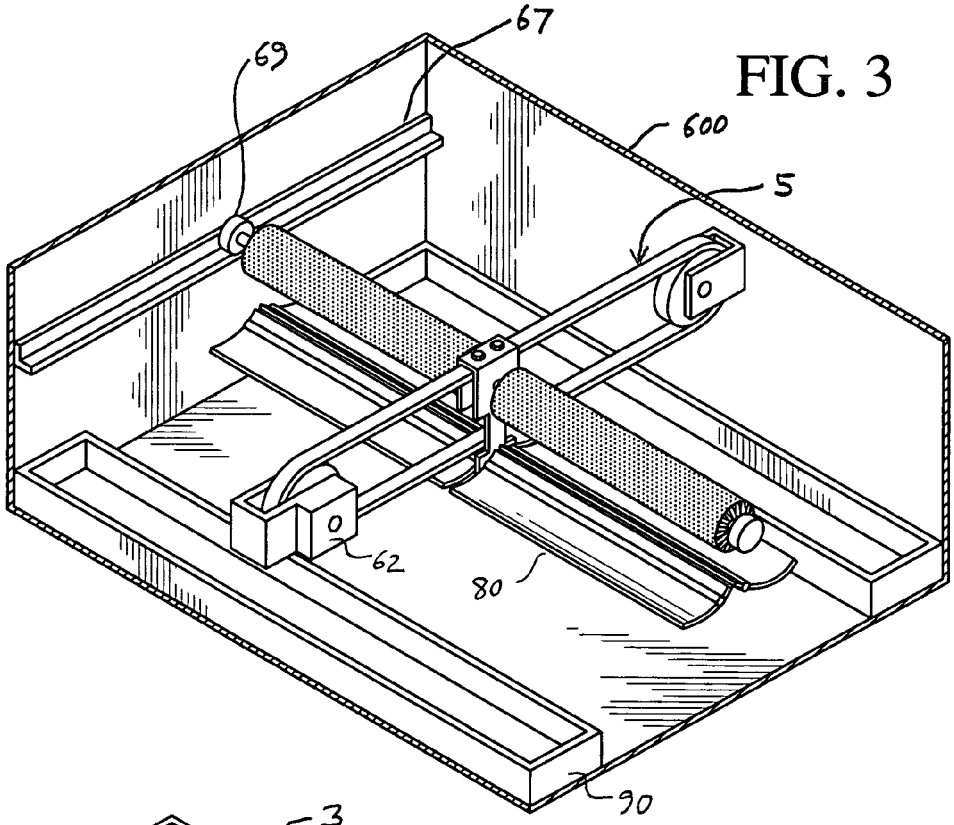
FIG. 3 is a perspective, partially cutaway view of the automated filter cleaner of the air conditioning unit of the present invention.
Figure 4:
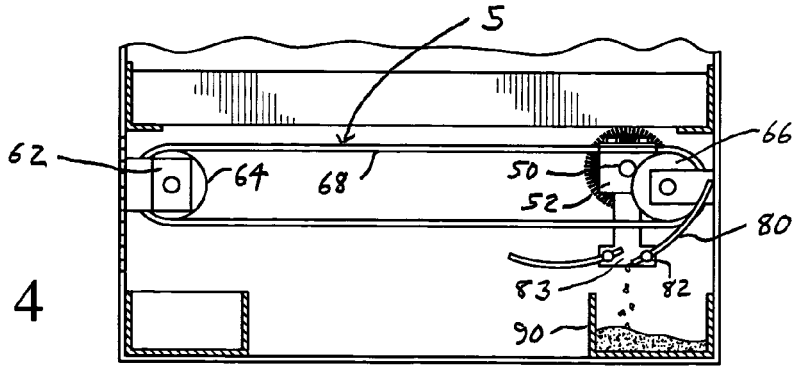
FIG. 4 is a partial side cutaway view of the automated filer cleaner of the air conditioning unit of the present invention.

FIGS. 1-4 illustrate the filter cleaning mechanism. The filter cleaning mechanism for cleaning a main filter 700 of an air-conditioning unit 6 is secured to the air-conditioning unit 6 and includes a bearing 50, a casing 52 housing the bearing 50 and a drive mechanism 5. The drive mechanism 5 is attached to the casing 52 and the drive mechanism 5 is configured to move the casing 52 between two positions. A rotative brush 70 includes first and second ends, and the bearing 50 is connected to the first end of the rotative brush 70. The embodiment illustrated in FIGS. 1 and 3 show a pair of brushes, but it is envisioned that the device can function with only a single brush, with the drive mechanism moved to a side of the air conditioning unit 6 to make room for the single brush. The outer portions of the rotative brushes 70 are configured to be in contact with a main filter 700 of an air-conditioning unit 6 such that when the casing 52 is moved by the drive mechanism 5, debris on the filter 700 is brushed away. The debris falls on two sets of a pair of flexible pans 80, as illustrated in FIG. 3. The pairs of flexible pans 80 are configured for receiving debris removed by the rotative brush, and may be arched or curved as illustrated in the figures, and may further include end sidewalls (not illustrated) below the first and second ends of the brush 70 so that the flexible pans 80 may better capture the falling debris. The flexible pans 80 are hinged to the casing such that when the drive mechanism moves the casing 52 to one of the two positions of the casing, a respective one of the flexible pans 80 slides along a surface of the air conditioned unit 6 and rotates at its hinge 82 and forms a gap 83 between the pair of flexible pans 80 in order to allow debris to fall through the gap 83, as best illustrated in FIG. 4. The flexible pans 80 may be rigid as opposed to being flexible, but it is more preferable to have the flexible property since a more rigid structure my result in premature breakdowns as the pan 80 is subjected to minor impacts.

The filter cleaning mechanism further includes at least one open container 90 for receiving debris dropped from the debris pans 90. FIGS. 2-4 illustrate a pair of open containers 90, the positions of which approximately corresponds to the first and second movement positions of the casing 52. FIG. 4 shows one of the first and second movement positions of the casing 52, and FIG. 2 shows the position of the casing 52 between the first and second movement positions of the casing 52, with the hinge 82 at a rest position.

One possible drive mechanism 5 may include a motor 62, a pair of pulleys 64 and 66, a continuous belt 68 secured between the pulleys 64 and 66. The casing 52 is attached to the continuous belt 68, and when the motor 62 rotates one of the pulleys 64 the casing 52 is moved between the two positions of the casing 52. The drive mechanism 5 is activated when an air flow sensor (not shown) indicates that air flow is reduced mainly because the main filter 700 is filled with debris. When the drive mechanism is activated, the blowers are turned off during the cleaning process and the brush 70 is moved once or back and forth between the pulleys 64 and 66 and the filter 700 is cleaned. After the brush 70 sufficiently cleans the filter 700, the drive mechanism is deactivated and the blowers of the air conditioner are turned back on. The air flow sensor can be positioned at the heat exchange unit 610.

The filter cleaning mechanism may include one or two rails 67 configured for attachment to opposing sides of the housing 600 of an air conditioning unit 6, and a roller 69 is attached to the second end of the brush 70 and configured to rotate on the rail 67 between the two positions of the casing 52. The rails 67 support some of the weight of the brush 70.

The present invention is by no means restricted to the above-described preferred embodiments, but covers all variations that might be implemented by using equivalent functional elements or devices that would be apparent to a person skilled in the art, or modifications that fall within the spirit and scope of the appended claims.

I claim:

1. A filter cleaning mechanism for cleaning a main filter of an air-conditioning unit comprising:

a bearing (50);

a casing (52) housing the bearing;

a drive mechanism (5) attached to the casing configured to move the casing between two positions;

a rotative brush (70) having first and second ends, the bearing is connected to the first end of the rotative brush;

outer portions of the rotative brush are configured to be in contact with a main filter (700) of an air-conditioning unit such that when the casing is moved by the drive mechanism, debris on such filter is brushed away; and a pair of debris pans (80) configured for receiving debris removed by the rotative brush, the debris pans are hinged to the casing such that when the drive mechanism moves the casing to one of the two positions of the casing, a respective one of the debris pans rotates at its hinge and forms a gap between the pair of debris pans in order to allow debris to fall through the gap.

2. The filter cleaning mechanism as claimed in claim 1, further comprising at least one container (90) for receiving debris dropped from the debris pans.

3. The filter cleaning mechanism as claimed in claim 1, wherein the drive mechanism comprises a motor (62), a pair of pulleys (64, 66), a continuous belt (68) secured between the pulleys, the casing is attached to the continuous belt, and when the motor rotates one of the pulleys the casing is moved between the two positions of the casing.

4. The filter cleaning mechanism as claimed in claim 1, further comprising:

a rail (67) configured for attachment to a housing of an air conditioning unit; and a roller (69) attached to the second end of the brush and configured to rotate on the rail between the two positions of the casing.

5. The filter cleaning mechanism as claimed in claim 1, further comprising:

an air flow sensor that detects reduced air flow and thereafter activates the drive mechanism.

* * * * *